US005673858A

United States Patent [19]

Asakawa et al.

[11] Patent Number: 5,673,858

[45] Date of Patent: Oct. 7, 1997

[54] FLUID JET NOZZLE APPARATUS

[75] Inventors: Hiroyoshi Asakawa, Nishinomiya; Yoshiyuki Kioi, Sanda, both of Japan

[73] Assignee: Kyoritsu Gokin Mfg. Co., Ltd., Hyogo-ken, Japan

[21] Appl. No.: 502,682

[22] Filed: Jul. 14, 1995

[30] Foreign Application Priority Data

Aug. 10, 1994 [JP] Japan ..... 6-187981

[51] Int. Cl.[6] ..... B05B 1/14

[52] U.S. Cl. ..... 239/553.3; 239/553.5; 239/562; 239/575; 239/590.3

[58] Field of Search ..... 239/568, 566, 239/553, 553.5, 597, 590.5, 575, 590, 553.3

[56] References Cited

U.S. PATENT DOCUMENTS

| | | | |
|---|---|---|---|
| 1,060,089 | 4/1913 | Higgins | 239/575 |
| 4,848,672 | 7/1989 | Matsumoto et al. | 239/590.5 |

FOREIGN PATENT DOCUMENTS

| | | | |
|---|---|---|---|
| 1913713 | 10/1970 | Germany | 239/568 |
| 4035008 | 8/1991 | Germany | 239/570 |
| 217642 | 6/1990 | Japan | B05B 1/30 |
| 190429 | 7/1994 | Japan | 239/570 |
| 252944 | 10/1970 | U.S.S.R. | 239/570 |

*Primary Examiner*—Kevin Weldon

*Attorney, Agent, or Firm*—Webb Ziesenheim Bruening Logsdon Orkin & Hanson, P.C.

[57] ABSTRACT

A fluid jet nozzle apparatus includes a fluid passage communicated with a fluid jet opening, a valve member for opening/closing the fluid passage, and an elastic member for biasing and moving the valve member to a passage closing position. The valve member includes a pressure receiving face for moving the valve member to a passage opening position against the biasing force of the elastic member in response to application thereto of a fluid pressure exceeding a predetermined pressure. The valve member and the elastic member are interposed between an entrance opening of the fluid passage and a strainer surrounding the entrance opening.

8 Claims, 4 Drawing Sheets

FLUID JET NOZZLE APPARATUS

BACKGROUND OF THE INVENTION

1. Field of the Invention

The present invention relates to a fluid jet nozzle apparatus, and more particularly to a fluid jet nozzle apparatus having a fluid passage communicated with a fluid jet opening, a valve member capable of opening/closing the fluid passage, an elastic member for biasing and moving the valve member to a passage closing position, and a pressure receiving face provided to the valve member for moving the valve member to a passage opening position against the biasing force of the elastic member in response to application thereto of a fluid pressure exceeding a predetermined pressure.

2. Description of the Related Art

With the fluid jet nozzle apparatus noted above, for stopping fluid jet from the fluid jet opening, the fluid pressure is lowered below the predetermined pressure to allow the valve member to move to the passage closing position by the biasing force of the elastic member for closing the fluid passage, thereby to prevent air introduced through the fluid jet opening from flowing to the upstream. For allowing the fluid to be discharged from the fluid jet opening, the fluid pressure is raised over the predetermined pressure to move the valve member to the passage opening position against the biasing force of the elastic member. Conventionally, the valve member is disposed in the middle of the fluid passage, the elastic member is provided for biasing and moving this valve member in the passage closing direction, and a fluid pressure introducing passage is provided for providing the fluid pressure to the pressure receiving face of the valve member (see e.g. Japanese published utility model gazette No. 2-17642).

For this reason, consideration needs to be made on the arrangements of the valve member and the fluid pressure introducing passage for acting on the pressure receiving face. Hence, the fluid passage circuit construction tends to be complicated, and also assembly operations of the valve member and the elastic member tend to be troublesome, thereby to increase the manufacture costs.

Moreover, due to the complicated passage circuit construction, the fluid introduced into the fluid passage tends to be disturbed. Then, in order to rectify such disturbed flow to achieve efficient fluid jet flow, this will lead to increase of the entire length of the flow passage, thereby to enlarge the entire apparatus.

The present invention attends to the above-noted state of the art, and its object is to reduce the manufacture costs of fluid jet nozzle apparatus through improvement of the attachment arrangements of the valve member and the elastic member and to form compact a fluid jet nozzle apparatus capable of allowing fluid introduced into the fluid passage to be discharged in an effective and efficient manner.

A further object of the invention is to facilitate the assembly and maintenance of the valve member and the elastic member.

SUMMARY OF THE INVENTION

For fulfilling the above-noted object, a fluid jet nozzle apparatus, according to the present invention, comprises:

a fluid passage communicated with a fluid jet opening;

a valve member for opening/closing the fluid passage;

an elastic member for biasing and moving the valve member to a passage closing position;

wherein, the valve member includes a pressure receiving face for moving the valve member to a passage opening position against the biasing force of the elastic member in response to application thereto of a fluid pressure exceeding a predetermined pressure; and the valve member and the elastic member are interposed between an entrance opening of the fluid passage and a strainer surrounding the entrance opening.

With the above-described construction, the fluid passage is opened/closed at a position between the entrance opening of the fluid passage and the strainer surrounding this entrance opening. Accordingly, the fluid passage may be readily formed simple without special consideration as to the arrangements of the valve member and the fluid pressure introducing passage for acting on the pressure receiving face. Further, this simplicity of the flow passage serves to reduce the possibility of occurrence of disturbance in the fluid introduced into this flow passage.

The simple flow passage may contribute also to reduction of the manufacture costs. As a result, the above construction has fulfilled the intended object of reducing the manufacture costs of fluid jet nozzle apparatus through improvement of the attachment arrangements of the valve member and the elastic member and also forming compact a fluid jet nozzle apparatus capable of allowing fluid introduced into the fluid passage to be discharged in an effective and efficient manner.

According to one aspect of the present invention, the elastic member is interposed between the valve member and the strainer to be elastically compressible by the valve member and the strainer.

In this case, the reaction force against the biasing force of the elastic member may be provided by the valve member and the strainer. So that, the attachment arrangement of the elastic member may be further simplified.

As a result, due to the simplification of the attachment construction of the elastic member, the manufacture costs may be further reduced.

According to a further aspect of the present invention, the valve member defines a communication passage communicated with the fluid passage; the valve member is biased to move to a communication flow passage closing position for closing this communication passage; and the communication passage and the flow passage are communicated with each other along a straight line.

With the above construction, the fluid to be discharged may be rectified in continuous series through the communication passage defined in the valve member and also the predetermined flow passage. As a result, this construction allows reduction in the length of the flow passage while effectively preventing occurrence of disturbance in the flow discharged through the fluid jet opening. Consequently, the entire fluid jet nozzle apparatus may be formed still more compact.

According to a still further aspect of the invention, the valve member and the elastic member are mounted and dismounted from a position outside the strainer.

In this case, the valve member and the elastic member may be mounted or dismounted with maintaining the other parts constituting the flow passage in the assembled condition.

Preferably, a valve seat is provided for contacting the valve member to form together the flow passage closing state; and at least a portion of this valve seat contacting the valve member is formed of a metal material and this portion projects (preferably, in the form of conical projection) toward the flow passage.

This construction may enhance the reliability of the flow passage closed state provided by the contact between the valve member and the valve seat. More specifically, the flow passage closed state may be secured for an extended period of time without fluid leakage. Hence, the maintenance operation of the fluid jet nozzle apparatus may be facilitated.

Further and other objects, features and effects of the invention will become more apparent from the following more detailed description of the embodiments of the invention with reference to the accompanying drawings.

DETAILED DESCRIPTION OF THE PREFERRED EMBODIMENTS

Preferred embodiments of a fluid jet nozzle apparatus relating to the present invention will be described hereinafter with reference to the accompanying drawings.

Figure 1:
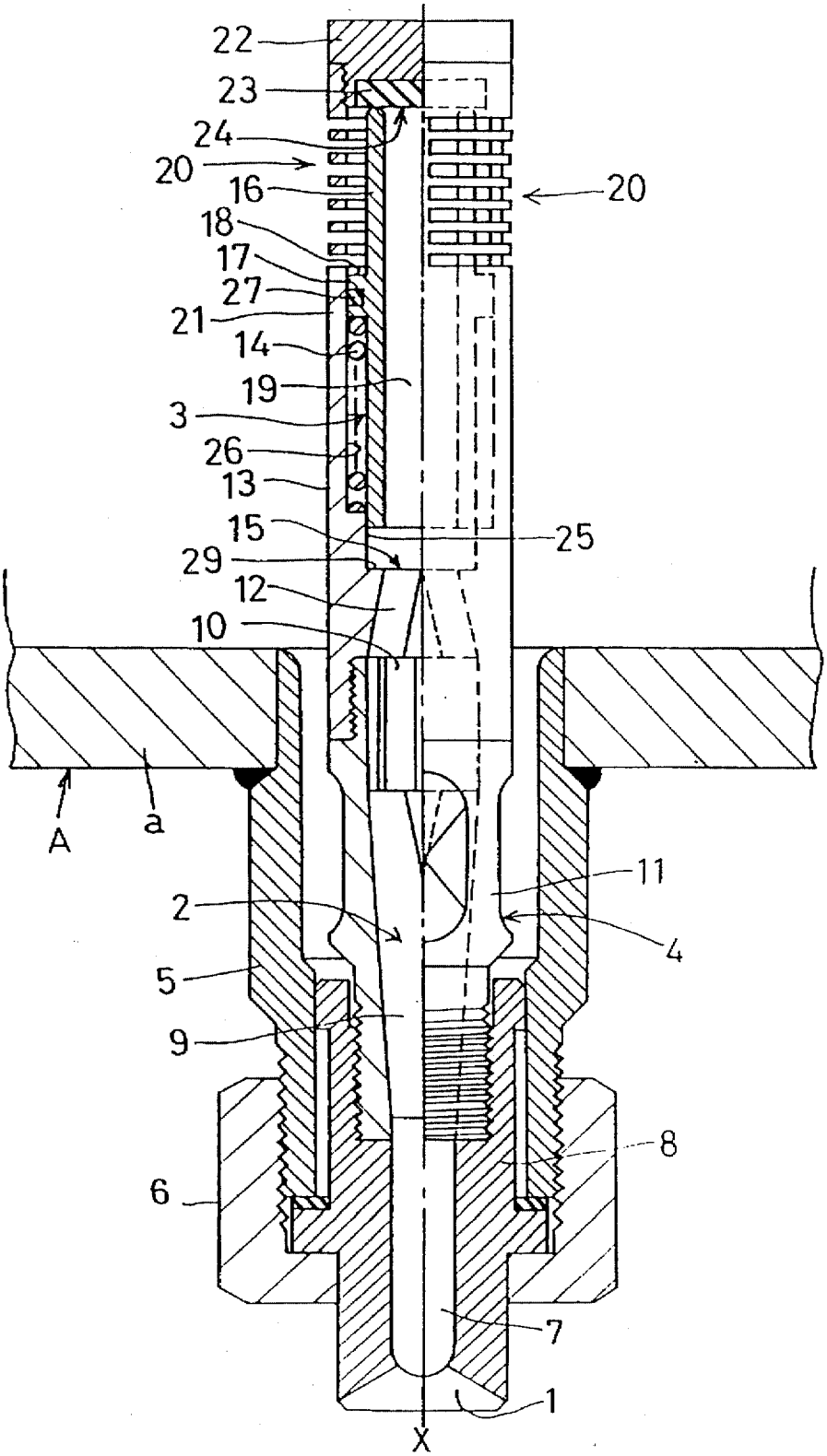
FIG. 1 a side view in partial section of a fluid jet nozzle apparatus according to one preferred embodiment of the present invention, FIGS. 2(*a*) and (*b*) are enlarged sectional views of principal portions illustrating operation conditions of a valve member.
Figure 2:
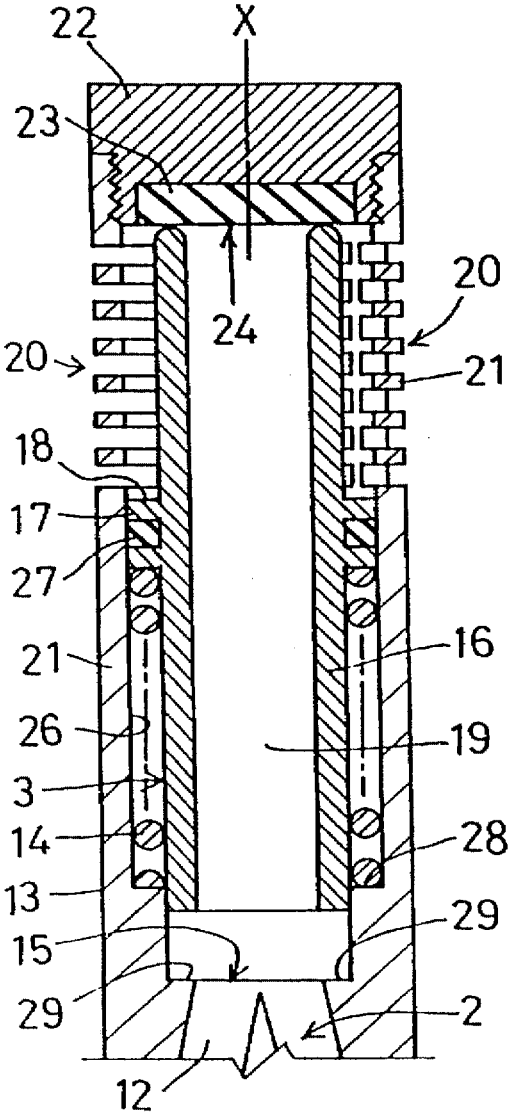
Figure 2:
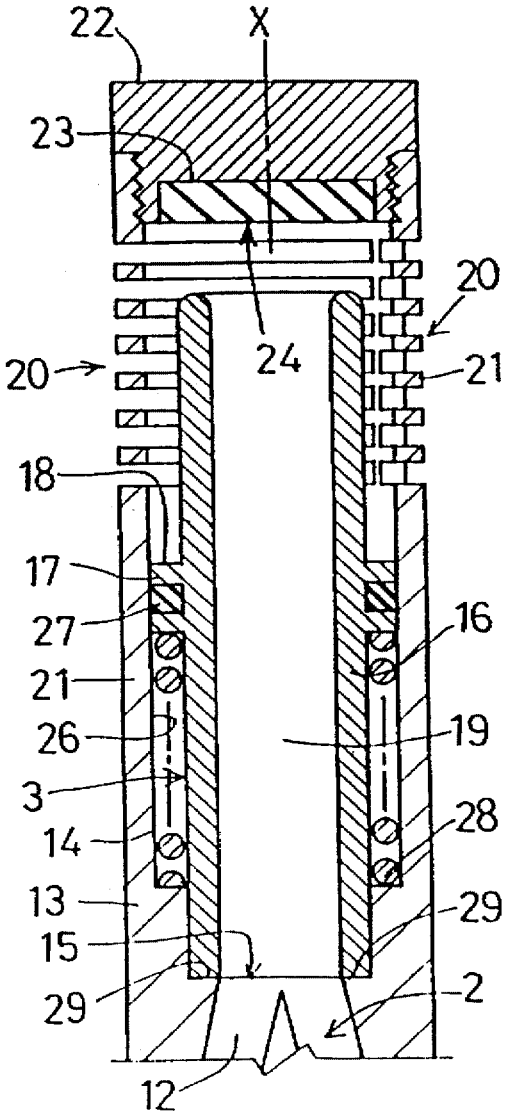

FIGS. 1 and 2 shows a high-pressure water jet nozzle apparatus for jetting high-pressure water (one example of fluid) in a wide fan-shaped spraying pattern on to a surface of steel object in order to eliminate scaling formed on the surface in the course of e.g. steel rolling process at a steel making factory. The nozzle apparatus includes a jet nozzle 4 having a high-pressure water flow passage 2 acting as a fluid passage communicated with a jet orifice 1 defining a fluid jet opening, and a valve member 3 capable of opening/closing this water flow passage 2. The jet nozzle 4 is withdrawably inserted into a cylindrical adapter 5 secured, by welding, to a pipe wall (*a*) of a high-pressure water supply pipe A and a cap 6 is threaded on the adapter 5, whereby the apparatus is detachably fixed.

The jet nozzle 4 includes a nozzle body 8 defining a jet flow passage 7 communicated with the jet orifice 1, a constricted cylinder 11 defining a constricted passage 9 in which a rectifying member 10 is press-fitted, and a strainer 13 defining a water introduction passage 12 for introducing the high-pressure water into the rectifying member 10, with the body 8, the cylinder 11 and the strainer 13 being threadably fixed with each other. Further, the valve member 3 and a coil spring 14 acting as an elastic member for biasing and moving the valve member 3 to a passage closing position are interposed between an entrance opening 15 of the high-pressure water passage 9 and the strainer 13 surrounding this entrance 20 opening 15. Then, the portion of the apparatus including the strainer 13 is inserted into the water supply pipe A.

The valve member 3 includes a cylindrical member 16 having fixed inner and outer diameters, and a flange 17 formed integrally on an outer periphery of the cylindrical member 16. One end face of this flange 17 provides a pressure receiving face 18 for moving the valve member 3 to a passage opening position against the biasing force of the coil spring 14. The cylindrical member 16 defines a cylindrical bore 19 which constitutes a communication passage communicated with the high-pressure water passage And, the cylindrical bore 19 and the water passage 2 are coaxially arranged and communicated with each other along a common straight axis.

The strainer 13 has a cylindrical outer periphery, and its peripheral wall 21 defines a plurality of slit-like water inlet openings for eliminating foreign substance from the high-pressure water to be introduced into the water passage 2. And, a plug 22 is threaded on one open end of this strainer 13. Further, an elastic element 23 such as of rubber is fitted into this plug 22, thereby to constitute a valve seat 24. The valve member 3 and the coil spring 14 are detachably inserted into the strainer 13 through the one open end of the strainer from the outside.

The peripheral wall 21 of the strainer 13 defines a small-diameter inner peripheral face 25 to which one end outer peripheral face of the cylindrical member 16 of the valve member 3 is fitted, and a large-diameter inner peripheral face 26 to which an outer peripheral face of the flange 17 of the valve member 3 is fitted. The valve member 3 with an elastic ring 27 fitted thereon is reciprocable within the strainer along a cylinder axis X. As the plug 22 is gradually threaded on the end opening, the valve 3 is pressed toward the rectifying member 10, whereby the coil spring 14 is elastically compressed between the flange 17 of the valve member B and a stepped portion 28 of the peripheral wall 21.

When the water pressure inside the water supply pipe A builds up, a water pressure over a predetermined pressure acts on the pressure receiving face 18. With this, as shown in FIG. 2(*b*), the valve member 3 comes into contact with an entrance stepped portion 29 of the water passage 2 against the biasing force of the coil spring 14 and at the same time moves away from the valve seat 24, whereby the valve member 3 moves to the passage opening position for opening up the communication passage 19 to allow the high-pressure water from the water supply pipe A to flow through the communication passage 19 into the water passage 2 to be eventually discharged from the jet orifice 1.

In this embodiment, the linearly extending communication passage 19 is formed in the valve member 3, and this communication passage 19 and the fluid (high-pressure water) passage 2 are linearly aligned with each other. Accordingly, the fluid, i.e. the high-pressure water is hardly disturbed and may smoothly flow into the entrance of the communication passage 19. This arrangement is advantageous for further restricting occurrence of disturbance of the fluid (high-pressure water) to be discharged from the fluid jet opening (jet orifice) 1.

Figure 3:
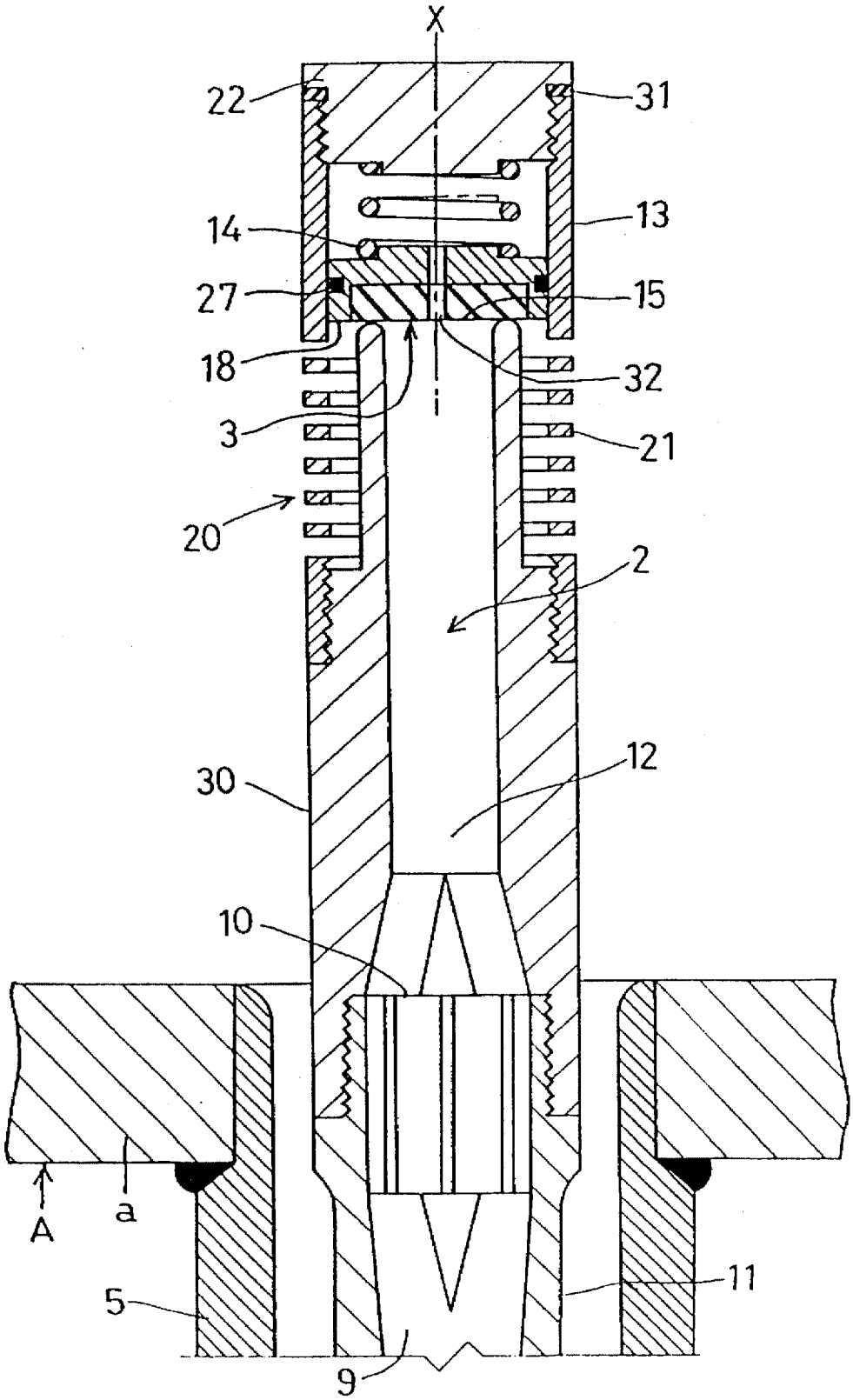
FIG. 3 is an enlarged section view of principal portions of a fluid jet nozzle apparatus according to a further embodiment of the present invention.

On the other hand, when the water pressure inside the water supply pipe A drops to provide a pressure lower than the predetermined pressure to the pressure receiving face 18, as shown in FIG. 2(*a*), the valve member 3 is moved, by the biasing force of the coil spring 14 through pressed contact with the valve seat 24, to the passage closing position for closing the communication passage 19, whereby the jetting operation of the high-pressure water from the jet orifice 1 is stopped and introduction of air to the upstream of the valve member 3 is also stopped. Next, other embodiments will be described. (1) FIG. 3 shows a further embodiment. In this, a valve member 3 for closing/opening a high-pressure water passage 2 and a coil spring 14 as the elastic member for biasing and moving the valve member 3 to the passage closing position are bound between an entrance 15 of the water passage 2 and a plug 22 for plugging the one open end of a cylindrical strainer 13. A high-pressure water introducing pipe 30 defining a water introducing passage 12 extending to a rectifying member 10 is threaded on a constricted cylinder 11, thereby to define the high-pressure water flow passage 2.

The strainer 13 is threadably fixed on the water introducing pipe 30, and its peripheral wall 21 defines a plurality of water inlet openings 20. The valve member 3 and the coil spring 14 are detachably inserted from one open end of the strainer 13. As the plug 22 is threaded to the one open end of the strainer via an elastic sealing element 31, the coil spring 14 is elastically compressed and mounted between the valve member 3 and the strainer 13.

The valve member 3 with an elastic ring 27 fitted thereon is reciprocable along an inner face of a peripheral wall 21 of the strainer 13 in the direction of a cylinder axis X. A portion of the valve member peripherally outside its outer periphery against which the water introducing pipe 30 is pressed, constitutes a pressure receiving face 18 for moving this valve member 3 to a passage opening position against the biasing force of the coil spring 14 in response to application thereto of a water pressure exceeding a predetermined pressure. The valve member 3 centrally defines a through bore 32 through which the rear side of the valve member 3 and the water passage 2 are communicated with each other.

When the water pressure inside the water supply pipe A builds up, a water pressure over a predetermined pressure acts on the pressure receiving face 18. With this, the valve member 3 moves to the passage opening position for opening up the entrance opening 15 of the water passage 2. When the water pressure inside the water supply pipe A drops to provide a pressure lower than the predetermined pressure to the pressure receiving face 18, the valve member 3 is moved, by the biasing force of the coil spring 14 through pressed contact with the open end of the water introducing passage 30, to the passage closing position for closing the entrance opening 15 of the water passage 2.

The other constructions of this embodiment are the same as those of the foregoing embodiment.

Figure 4:
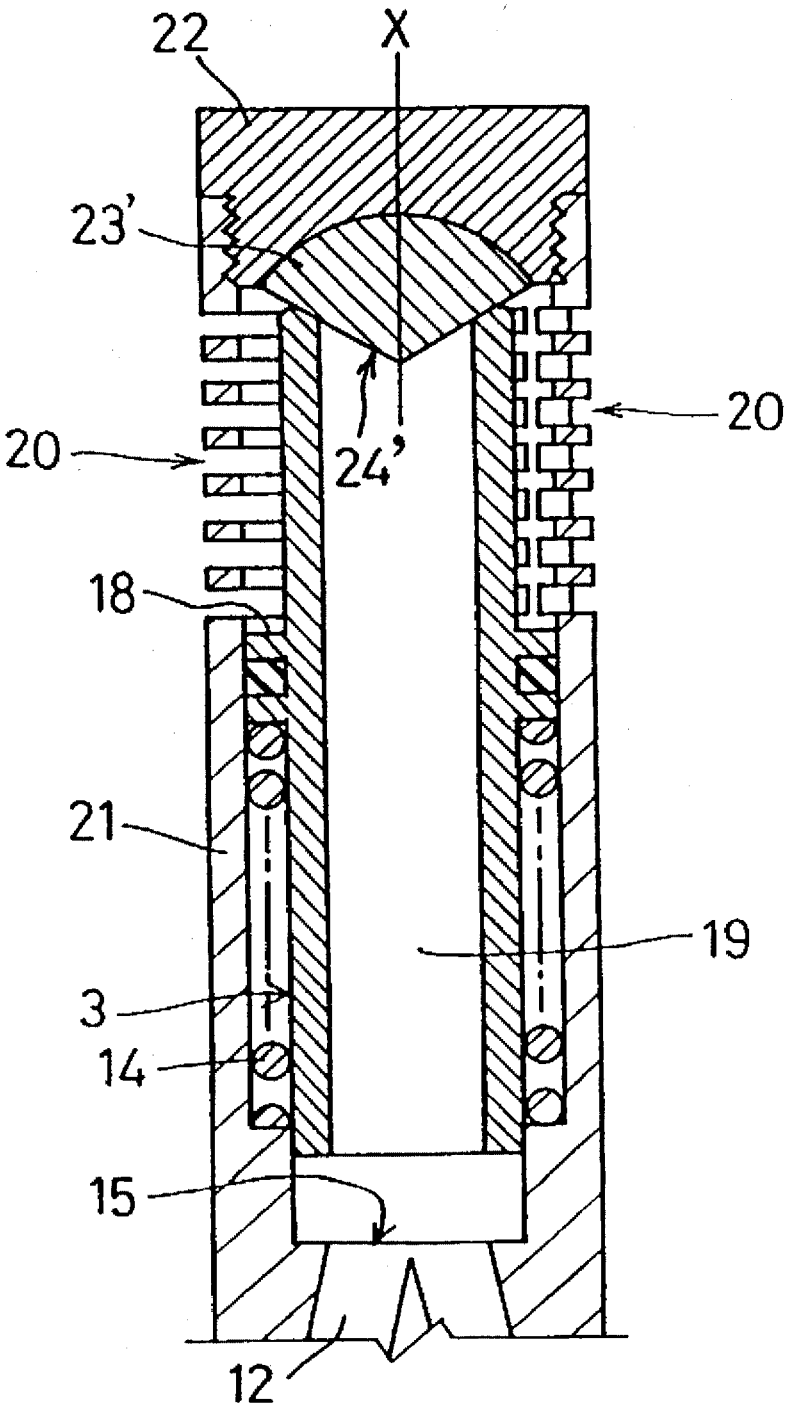
FIG. 4 is an enlarged section view of principal portions of a fluid jet nozzle apparatus according to a still further embodiment of the present invention.

(2) FIG. 4 shows a modified construction of the constructions shown in FIGS. 1 and 2, in which, instead of the elastic member 23 attached to the bottom end of the plug 22, the portion of the valve seat 24' contacting one end of the valve member 3 is formed of a metallic material 23' (preferably, stellite or the like having good friction-resistant and corrosion-resistant properties) and this portion is formed as a conical portion projecting toward the fluid passage 2. In comparison with the case using the elastic member formed of e.g. rubber, this modified construction is superior in durability. Moreover, even if displacement occurs in the position contacting the valve member, it is possible to reliably prevent water leakage when the valve is closed. In this case, the entire valve seat may be formed integrally of e.g. the stellite. Or, only its portion against which the valve member contacts or where such displacement may occur, may be formed of the stellite or the like and then this portion may then be fitted into a plug-like body constituting the valve seat.

The other constructions are the same as those of the foregoing embodiment.

(3) This fluid jet nozzle apparatus may be constructed as a jet nozzle apparatus for any other fluid than water, such as any other liquid, or gas or a gas-liquid mixture and so on.

(4) Accordingly, the strainer may be used for eliminating foreign substance from any gas or gas-liquid mixture also.

(5) The valve member for closing/opening the fluid passage may be formed as a spool type valve.

(6) Inside the strainer, any separate support member, other than the strainer per se, may be provided for providing the reaction force against the biasing force from the elastic member.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. A fluid jet nozzle apparatus comprising:

a fluid passage in flow communication with a fluid jet opening, the fluid passage including an entrance opening;

a strainer surrounding the entrance opening, the strainer having at least one open end, a plug for plugging the at least one open end of the strainer;

a valve member movable within the strainer and configured to open and close the fluid passage; and an elastic member for biasing and moving the valve member to a passage closing position, wherein the valve member includes a pressure receiving face for moving the valve member to a passage opening position against a biasing force of the elastic member in response to the application thereto of a fluid pressure exceeding a predetermined pressure, and wherein the valve member and the elastic member are interposed between the entrance opening of the fluid passage and the strainer, and wherein the valve member and the elastic member are interposed between the entrance opening of the fluid passage and the plug.

2. A fluid jet nozzle apparatus as claimed in claim 1, wherein the elastic member is interposed between the valve member and the strainer and is elastically compressible by the valve member and the strainer.

3. A fluid jet nozzle apparatus as claimed in claim 1, wherein the valve member defines a communication passage in flow communication with the fluid passage; the valve member is biased to move to a communication passage closing position for closing this communication passage; and the communication passage and the fluid passage are communicated with each other along a straight line.

4. A fluid jet nozzle apparatus as claimed in claim 1, wherein the strainer is removably connected to a nozzle body and wherein the valve member and the elastic member are adapted to be inserted into and removed from the strainer without removing the strainer from the nozzle body.

5. A fluid jet nozzle apparatus as claimed in claim 2, wherein the valve member defines a communication passage in flow communication with the fluid passage; the valve member is biased to move to a communication passage closing position for closing this communication passage; and the communication passage and the fluid passage are communicated with each other along a straight line;, and wherein the valve member and the elastic member are removably mounted in the strainer.

6. A fluid jet nozzle apparatus as claimed in claim 5, including a rectifying member, wherein the strainer defines a water introducing passage for introducing high-pressure water into the rectifying member, and wherein the strainer is connected with a nozzle body defining a jet flow passage communicated with the fluid jet opening.

7. A fluid jet nozzle apparatus as claimed in claim 6, wherein the water passage, a flow passage defined inside the rectifying member and the jet flow passage together form one stepless continuous passage.

8. A fluid jet nozzle apparatus as claimed in claim 1, including a valve seat, wherein the valve member contacts the valve seat to close the fluid passage wherein at least a portion of the valve seat contacting the valve member in a closed position is formed of a metal material and wherein the portion projects toward the fluid passage.

* * * * *